United States Patent [19]

Nielsen et al.

[11] Patent Number: 4,811,917

[45] Date of Patent: Mar. 14, 1989

[54] TUBE FOR YARN BOBBINS

[76] Inventors: Hans B. Nielsen; Eva K. Nielsen, both of Lutertalstrasse 33, CH-3065 Bolligen/Bern, Switzerland

[21] Appl. No.: 149,553

[22] Filed: Jan. 28, 1988

[30] Foreign Application Priority Data

Feb. 3, 1987 [DE] Fed. Rep. of Germany ..... 3703067

[51] Int. Cl.[4] ..... B65H 75/20

[52] U.S. Cl. ..... 242/118.1; 68/198; 242/118.3

[58] Field of Search ..... 242/118.1, 118.11, 118.3, 242/118.31, 118.32, 118; 68/189, 198

[56] References Cited

U.S. PATENT DOCUMENTS

| | | | |
|---|---|---|---|
| 3,908,409 | 9/1975 | Nielsen | 68/189 |
| 4,084,413 | 4/1978 | Nielsen | 68/189 |
| 4,176,811 | 12/1979 | Becker et al. | 242/118.1 |
| 4,180,219 | 12/1979 | Becker et al. | 242/118.1 |
| 4,209,143 | 6/1980 | Hahm et al. | 242/118.11 |
| 4,272,037 | 6/1981 | Becker et al. | 242/118.1 |
| 4,379,529 | 4/1983 | Nielsen | 242/118.11 |
| 4,402,474 | 9/1983 | Henning | 242/118.1 |
| 4,491,286 | 1/1985 | Nielsen | 242/118.11 |
| 4,545,222 | 10/1985 | Rost | 242/118.1 |
| 4,667,895 | 5/1987 | Becker et al. | 242/118.1 |

FOREIGN PATENT DOCUMENTS

| | | | |
|---|---|---|---|
| 3525311 | 1/1987 | Fed. Rep. of Germany | 242/118.1 |

*Primary Examiner*—Stanley N. Gilreath

*Attorney, Agent, or Firm*—Cushman, Darby & Cushman

[57] ABSTRACT

In a plastic tube for yarn bobbins having a substantially cylindrical body one end is broader than the other so that two tubes can be axially inserted into each other. The broad end is provided with perforations for through flow of dye liquid whereas the narrow end is without perforations. The tube is provided with longitudinal ribs to carry the yarn. These ribs connect the two ends of the tube. Thereby an annular opening is established which is bridged only by the ribs. Dye liquid can from this opening enter the passages on the narrow end bounded by the ribs and the yarn.

3 Claims, 4 Drawing Sheets

TUBE FOR YARN BOBBINS

BACKGROUND OF THE INVENTION

The present invention relates to a tube of plastic for yarn bobbins of the type which consists of a substantially cylindrical body having a broad end and a narrow end, respectively, of such dimensions that the narrow end of one such tube can fit inside the broad end of another so that two tubes can be inserted partially into each other, which is provided with perforations which permit liquid to pass through the tube and the exterior of which is provided with longitudinal ribs designed to carry the yarn (the yarn bobbin) wound on the tube.

Tubes of this type are used for liquid treatment of yarn, especially dyeing with subsequent drying in an apparatus in which several tubes with yarn are placed in succession and partially inserted into each other on perforated distributor pipes or sectional spears through which the treatment liquid is pumped in and out through the yarn bobbins.

In order to make the most of the space, in the dyeing apparatus mainly, such tubes are used as are of a design which enables compression of the yarn bobbins in the longitudinal direction of the distributor pipes, i.e. in the longitudinal direction of the tubes.

DESCRIPTION OF THE PRIOR ART

A known tube which permits such compression of the yarn bobbins is a cylindrical tube which consists of a number of ribs extending over the entire length of the tube, the outer surfaces of which are located in a cylinder surface and which are connected by a number of concentric rings so that the openings between the rings and the ribs constitute the perforations which permit passage of liquid through the tube. The ring in one end of the tube is of a larger diameter than the other rings and is provided on the inside with a number of recesses which make it possible that the end (the narrow end) of a neighbour tube can be inserted a certain distance into this end (the broad end).

Another known tube which permits compression of the yarn bobbins is a conical tube, the narrow end of which can be inserted a distance into the broad end of a neighbour tube. The broad end is provided with perforations or is made like a latticework, whereas the remaining part of the tube is composed of interconnected conical or cylindrical rings with perforations or openings. On the outside of the rings is a number of ribs along the length of the tube, the outer surface of which ribs carry the yarn.

Both of these known tubes suffer from the drawback that they cannot provide a lasting tightening between two tubes.

During a dyeing process the dye liquid is heated and cooled several times, spent dye liquid is drained off and renewed and the direction of flow of the dye liquid through the bobbins is constantly changed from being from inside out to being from outside in and vice versa. The result of all these manipulations is that, although at the beginning of the process the yarn bobbins are pressed together with good tightness between the bobbins, interspaces or channels are formed between the yarn bobbins so that when the circulation pump is started again the dye liquid will find its way through these interspaces between the bobbins where the resistance to flow is lowest. This takes place, in particular between the bobbins which are placed nearest the end of the distributor pipe and between the outermost tube and the closure cap. The result of this is that part of the dye liquid is lost to dyeing when the direction of flow is from the inside out.

It is commonly known that once channels have formed between the bobbin they cannot be closed again or only partially so. This effect must then be counteracted by compressing the yarn bobbins again after each draining-off of the dye liquid by the re-tightening of each individual distributor pipe. This is a time-consuming and unpleasant work, seeing that, depending on the temperature of the yarn bobbins, there may be generation of steam, but apart from this, such re-tightening cannot quarantee that the channels between the bobbins become quite closed.

SUMMARY OF THE INVENTION

This drawback is avoided by means of the tube according to the invention which is so designed that, when circulation of the liquid is from inside out, it directs the flow of liquid in such a manner that it compresses the bobbins.

The tube according to the invention is characterized in that the broad end is provided with perforations for through-flow of liquid and the narrow end of the tube, is without perforations for through flow of liquid and is provided with longitudinal ribs to carry the yarn, which ribs form the only connection between the broad end and the narrow end so that, between the broad end and the narrow end of the tube, there is an annular opening bridged only by the ribs.

According to the invention, the ribs are preferably shaped in the way that, over a section of their length they increase in height in the direction towards the broad end of the tube, so that their yarn carrying outer surfaces are flush with the outer surface of the broad end of the tube at the point where they are connected with the broad end. The advantage hereby obtained is that, in the narrow end of the tube, the ribs have a low height corresponding to the standard external dimensions of tubes at the same time as the passages for liquid between the ribs obtain a diminishing cross-section over a certain section in accordance with the diminishing need for supply of liquid to the narrow end of the tube.

The broad end of the tube preferably consists of several concentric rings, the outer surfaces of which constitute the yarn carrying surface. Accordingly the spaces between the rings constitute the perforations through which liquid can flow so that there is no risk that the perforations become closed by being situated opposite points of a distributor pipe where there are no perforations.

BRIEF DESCRIPTION OF THE DRAWINGS

The invention is further illustrated with reference to the drawings in which.

DESCRIPTION OF PREFERRED EMBODIMENTS

Figure 1:
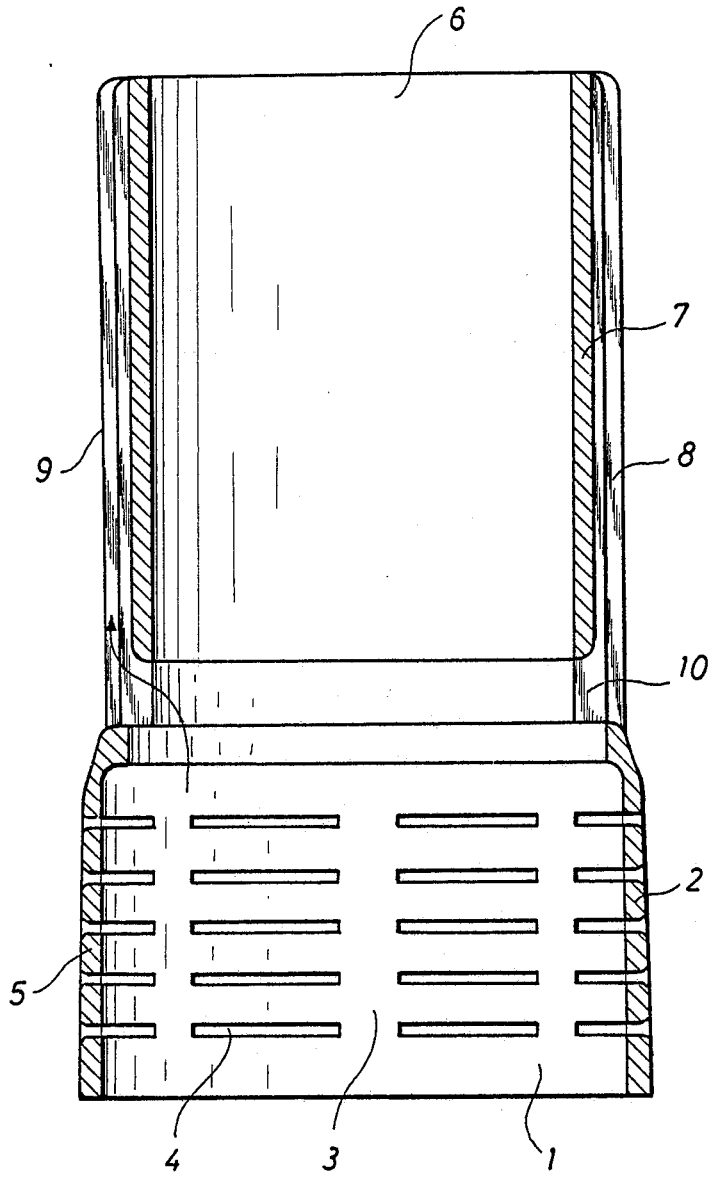
FIG. 1 shows an embodiment of a tube in longitudinal section.

The tube shown in FIG. 1 has a broad end 1 which constitutes about ⅓ of the length of the tube. This broad end is composed of a plurality of concentric rings 2 held together by longitudinal connecting pieces 3, and the spaces 4 between the rings constitute the perforations which permit the liquid to pass through this end of the tube and out through the yarn bobbins which are wound on the cylinder surface formed by the outer surface 5 of the concentric rings, there being no longitudinal ribs to carry the yarn in this end of the tube. The narrow end 6 of the tube constitutes about ⅔ of the length of the tube and is a cylinder surface 7 without perforations for the passage of the liquid. On its outside the cylinder is provided with a number of longitudinal ribs 8 the outer surface of which carry the yarn. These ribs are the only connection between the narrow end and the broad end of the tube so that at the transition between these two parts of the tube there are a number of openings 10 between the ribs through which liquid can pass as shown by the arrow in the drawing from the distributor pipe inside the tube out into the passages which are bounded by the outer surface of the cylinder 7, the ribs 8 and the yarn wound on the ribs.

Figure 2:
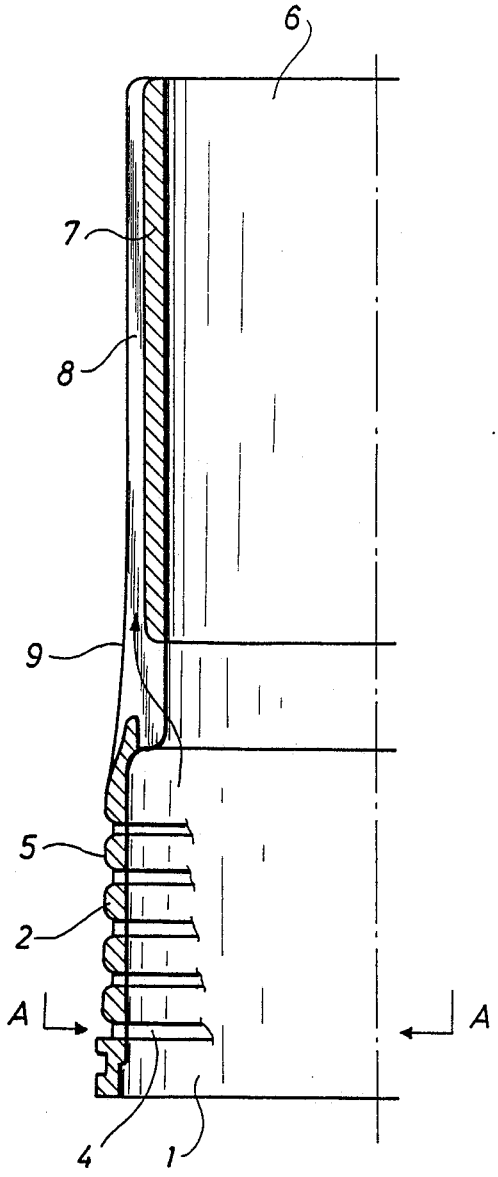
FIG. 2 shows a different embodiment of a tube in longitudinal section.
Figure 3:
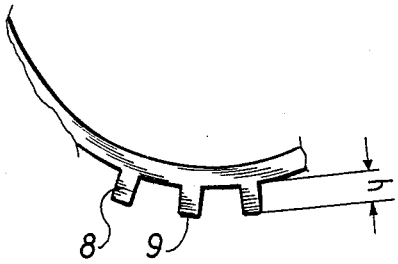
FIG. 3 is a partial end view of the narrow end of the embodiment shown in FIG. 2.
Figure 4:
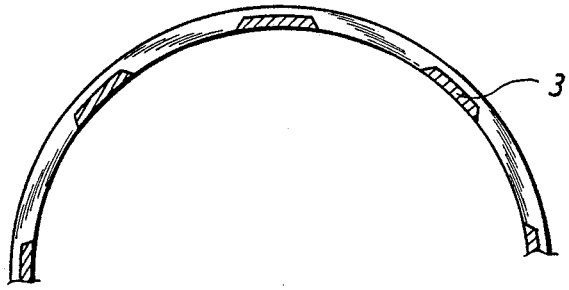
FIG. 4 is a partial section on the line A—A of FIG. 2.

FIGS. 2, 3, and 4 show a preferred embodiment of a tube according to the invention. Here the broad end of the tube is shaped in a similar manner as shown in FIG. 1, consisting of a plurality of concentric rings 2 with spaces 4 between them and the outer surface 5 of which carry the yarn. The narrow end 6 of the tube, as in FIG. 1, is constituted by a cylinder 7 without perforations, but in this embodiment the ribs 8 are shaped with increasing height over the middle third of the tube so that the outer surface 9 of the ribs are flush with the outer surface 5 of the broad end of the tube. Thereby the passage between the cylinder 7, the ribs 8 and the yarn will have a diminishing cross-section in the direction of flow of the liquid when the liquid is pumped from the inside,out through the tube. Hereby, the height h of the ribs (see FIG. 3) in the outermost third of the narrow end of the tube can be made lower.

Figure 5:
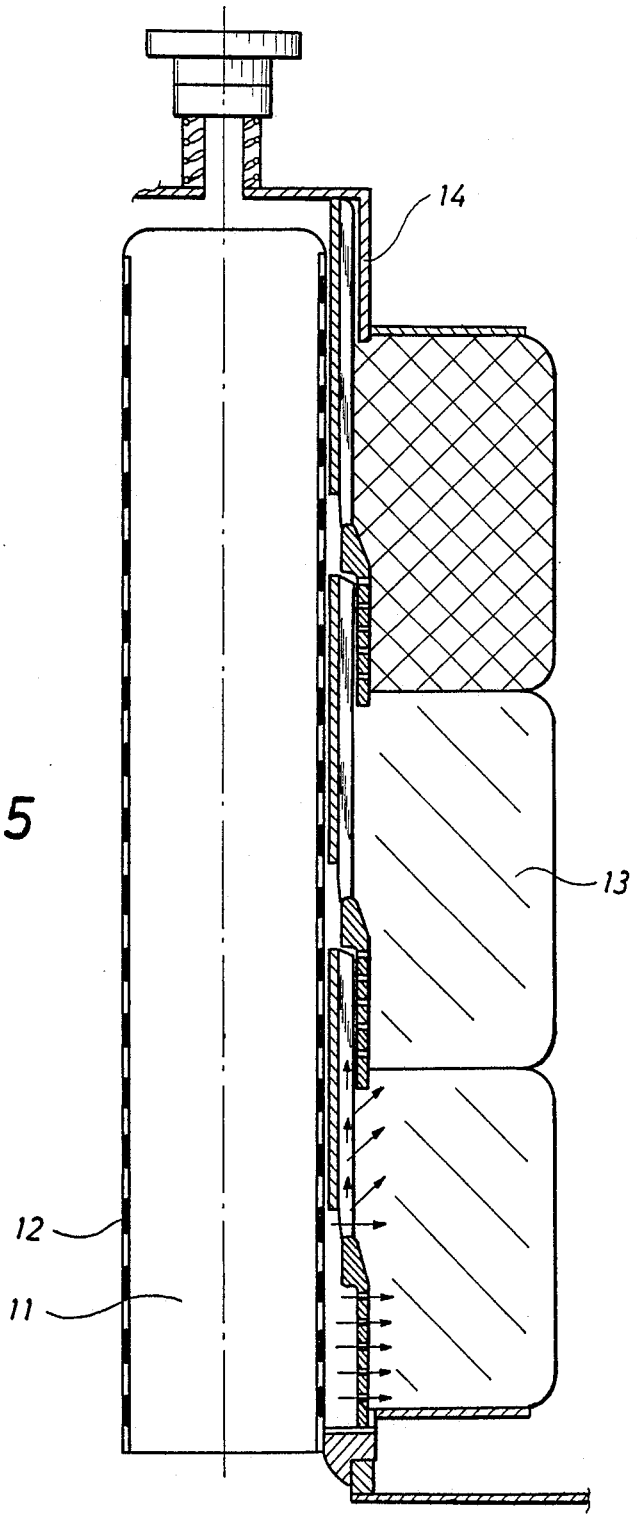
FIG. 5 shows a distributor pipe carrying three tubes with yarn bobbins.

In FIG. 5 is shown a distributor pipe 11 with perforations 12 on which are placed three tubes having yarn bobbins 13 wound on them. The yarn bobbins are compressed and held in position by a closure cap 14. When the liquid in the apparatus is drained off, channels will form between the yarn bobbins, no matter if the apparatus is one with vertical, or one with horizontal distributor pipes, and also a channel or an interspace between the outermost bobbin and the closure cap. When using the known tubes, these channels will not be completely closed again when the apparatus is refilled with liquid, and in case of circulation from the inside, out a considerable part of the treatment liquid will therefore pass through these channels and be lost to treatment of the yarn. Using the tubes according to the invention, however, the flow of liquid shown by the arrows in FIG. 5 is obtained. In the broad end of the tube, the liquid will flow radially outward through the yarn, and in the narrow end of the tube the liquid will have both a radial and an axial velocity component with the result that a resultant of the flow is obtained which is directed obliquely outward and forward and thereby stretches the individual bobbins in their longitudinal direction and presses bobbin against bobbin and the outermost bobbin against the closure cap, whereby the created channels are tightened. When the direction of flow of the liquid is changed to be from the outside, in the yarn is compressed and pressed against the surface of the tube so that the previously established tightening is maintained, in part by the compression of the yarn and in part by the friction of the yarn against the surface of the tube.

In the foregoing, the tube has been described as being a substantially cylindrical body, whereby is meant that it is the cylindrical shape that is aimed at and is desirable, as distinct from the conical shape, which gives problems with the yarn getting jammed when the narrow end is pushed into the broad end.

We claim:

1. A yarn bobbin support tube, comprising:

a substantially cylindrical tubular body made of plastic material, said tubular body including a broad end portion coaxially juxtaposed longitudinally spacedly adjacent a narrow end portion, and longitudinally extending means connecting said broad end portion with said narrow end portion;

said broad end portion including a plurality of first openings extending radially therethrough, thereby perforating said broad end portion;

said narrow end portion including a plurality of circumferentially spaced, longitudinally extending external ribs collectively having radially outer surfaces disposed on a notional cylinder having an external diameter, said narrow end portion thereby being externally ribbed to permit bearing a spiral wrapping of yarn thereabout along part of the length thereof, while facilitating application of a fluid treatment to such yarn;

said external ribs having longitudinal extensions beyond said narrow end portion, which provide said connecting means and define second openings radially through said tubular body angularly therebetween;

said narrow end portion being substantially unperforated thicknesswise thereof, and said broad end portion having an open end with an internal peripheral surface having a given diameter which is selected to permit said narrow end portion of a like said yarn bobbin support to be longitudinally removably telescopically nested throughout at least a part of the length thereof in said broad end portion, with the radially outer surfaces of the external ribs of the narrow end portion of the like yarn bobbin support tube engaging the internal peripheral surface of said broad end portion so as to define longitudinal channels between the two yarn bobbin support tubes.

2. The yarn bobbin support tube of claim 1, wherein:

said broad end portion has an external peripheral surface with a given external diameter which is larger than said external diameter of said notional cylinder on which said radially outer surfaces of said external ribs are disposed; and said longitudinal extensions of said external ribs gradually increase in external diameter from said narrow end portion towards said broad end portion so as to achieve, at said broad end portion, a diameter substantially equal to said given external diameter of said external peripheral surface of said broad end portion.

3. The yarn bobbin support tube of claim 1, wherein:

said broad end portion is constituted by a plurality of longitudinally spaced coaxial rings interconnected by a plurality of circumferentially spaced longitudinally extending connecting pieces, with said first openings being defined as slots between respective rings and connecting pieces, to permit a spiral wrapping of yarn about said narrow end portion to extend onto and also be provided on said broad end portion.

* * * * *